US006067660A

United States Patent [19]

Contini

[11] Patent Number: 6,067,660

[45] Date of Patent: May 30, 2000

[54] APPLIQUÉ METHOD AND ARTICLE

[76] Inventor: James A. Contini, 2821 2nd Ave., Suite 2101, Seattle, Wash. 98121

[21] Appl. No.: 09/324,534

[22] Filed: Jun. 2, 1999

[51] Int. Cl.[7] ..... A41D 27/08

[52] U.S. Cl. ..... 2/246; 2/69; 2/115; 2/DIG. 1; 40/586; 428/101; 428/914

[58] Field of Search ..... 2/69, 47, 48, 49.1, 2/49.4, 74, 75, 77, 79, 90, 105, 106, 108, 115, 206, 243, 244, 246, 249, DIG. 1; 40/586; 428/190, 196, 101, 914, 68; 442/68, 195, 196; 450/92; D2/717, 862, 844; D20/24, 30

[56] References Cited

U.S. PATENT DOCUMENTS

| | | | |
|---|---|---|---|
| 2,671,902 | 3/1954 | Grue | 2/69 |
| 4,140,563 | 2/1979 | Sernaker . | |
| 4,466,136 | 8/1984 | Bottom et al. | 2/115 |
| 4,813,081 | 3/1989 | Cliff et al. . | |
| 4,815,149 | 3/1989 | Erhardt et al. . | |
| 4,837,864 | 6/1989 | Thill | 2/244 |
| 4,999,848 | 3/1991 | Oney | 2/115 |
| 5,005,219 | 4/1991 | Diaz . | |
| 5,073,222 | 12/1991 | Fry | 156/267 |
| 5,175,888 | 1/1993 | Clark . | |
| 5,347,658 | 9/1994 | Clark . | |
| 5,379,461 | 1/1995 | Wilmers | 2/115 |
| 5,515,542 | 5/1996 | Simmons . | |
| 5,544,365 | 8/1996 | Mondy | 2/115 |
| 5,600,850 | 2/1997 | Shannon | 2/69 |
| 5,618,546 | 4/1997 | Wood et al. | 424/402 |
| 5,636,385 | 6/1997 | Harrison . | |
| 5,737,775 | 4/1998 | Schwartz . | |
| 5,840,408 | 11/1998 | Giansetto . | |
| 5,858,496 | 1/1999 | Fisher et al. | 428/44 |
| 5,933,866 | 8/1999 | Fox | 2/115 |
| 5,943,698 | 8/1999 | Blanks | 2/69 |
| 5,960,476 | 10/1999 | Danzy | 2/115 |

*Primary Examiner*—Diana Oleksa
*Assistant Examiner*—Katherine Moran
*Attorney, Agent, or Firm*—Christensen O'Connor Johnson & Kindness PLLC

[57] ABSTRACT

A method of appliqué and the resulting article is described that includes forming a first image (20) on a mesh-like material layer (18), forming a second image (24) on an underlying substrate (22), and attaching the mesh-like material layer to the substrate so that the first image overlays the second image. The first and second images are substantially the same images. In one embodiment, the mesh-like material layer is attached to the substrate such that the first image directly overlays the second image. In another embodiment, the mesh-like material layer is attached to the substrate such that the first image overlays the second image at a slight offset. By attaching the mesh-like material layer over the substrate in either of these ways, the resulting combined image appears three-dimensionalized.

14 Claims, 2 Drawing Sheets

APPLIQUÉ METHOD AND ARTICLE

FIELD OF THE INVENTION

The present invention relates to textile articles, and more particularly to novelty garments and the like.

BACKGROUND OF THE INVENTION

Clothing articles are currently available in a wide range of styles. A popular theme has been to form the article with a three-dimensional object, or the appearance of a three-dimensional object. For example, U.S. Pat. No. 4,813,081 describes a garment, such as a T-shirt, having a partially complete design placed on the shirt's front side. One or more holes are cut into the garment at locations within the partial design. The holes are configured to be physically and functionally related to the design to allow portions of the user's flesh to appear through the hole and complete the design. U.S. Pat. No. 4,815,149 describes a T-shirt having a design in which actual three-dimensional elements are attached to T-shirt. U.S. Pat. No. 5,636,385 describes a T-shirt having an actual hologram sheet displayed through a window of a flexible frame member.

While each of these techniques are visually interesting, they all have disadvantages. The '081 arrangement would likely cause the wearer to become cold when the garment is worn due to its various cut-outs. The '149 arrangement has three-dimensional objects that making cleaning the garment difficult. The '385 arrangement appears to be expensive to manufacture and also appears to require special handling during cleaning.

Thus, a need exists for a simple, effective method of forming a three-dimensional display on a garment and such a resulting garment. The optimal method would not require expensive manufacturing techniques and would be easily washed. The present invention is directed to fulfilling these needs and others as described below.

SUMMARY OF THE INVENTION

In accordance with aspects of the present invention, a method of appliqué and the resulting article is provided. The method includes forming a first image on a mesh-like material layer, forming a second image on an underlying substrate, and attaching the mesh-like material layer to the substrate so that the first image overlays the second image. The first and second images are substantially the same images. In one embodiment, the mesh-like material layer is attached to the substrate such that the first image directly overlays the second image. In another embodiment, the mesh-like material layer is attached to the substrate such that the first image overlays the second image at a slight offset. By attaching the mesh-like material layer over the substrate in either of these ways, the resulting combined image appears three-dimensionalized.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention is a method of producing a three-dimensionalized design on a textile substrate and the resulting article. The method may be used with a garment, a tablecloth, a quilt, fabric art, or other flexible textile object.

Figure 1:
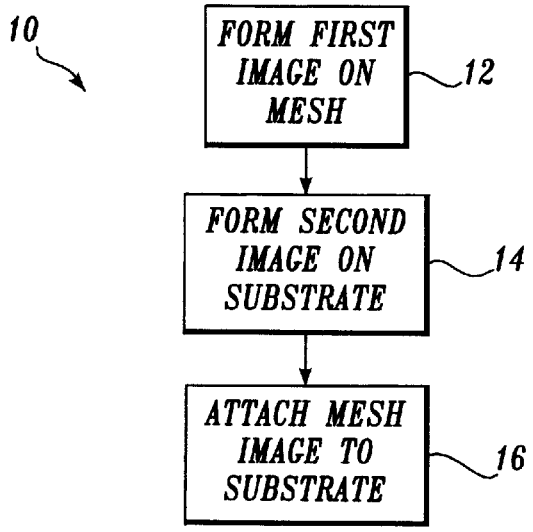
FIG. 1 is a flow diagram illustrating a method of forming an appliqué article formed in accordance with the present invention.

Referring to FIG. 1, a method 10 of forming an appliqué garment formed in accordance with the present invention includes creating a first image on a mesh-like material layer at step 12, creating a second image on an underlying substrate at step 14, and attaching the mesh-like material layer to the substrate at step 16. The order of steps 12 and 14 may be switched, whereby the second image is created and then the first image is created. The first and second images are either the same image or substantially the same image, with slight variations introduced in shading, color, texture, line-weight, size, or the like. In one preferred embodiment, the first image is the same image only enlarged in size by an amount of up to 5% relative to the second image.

Figure 2:
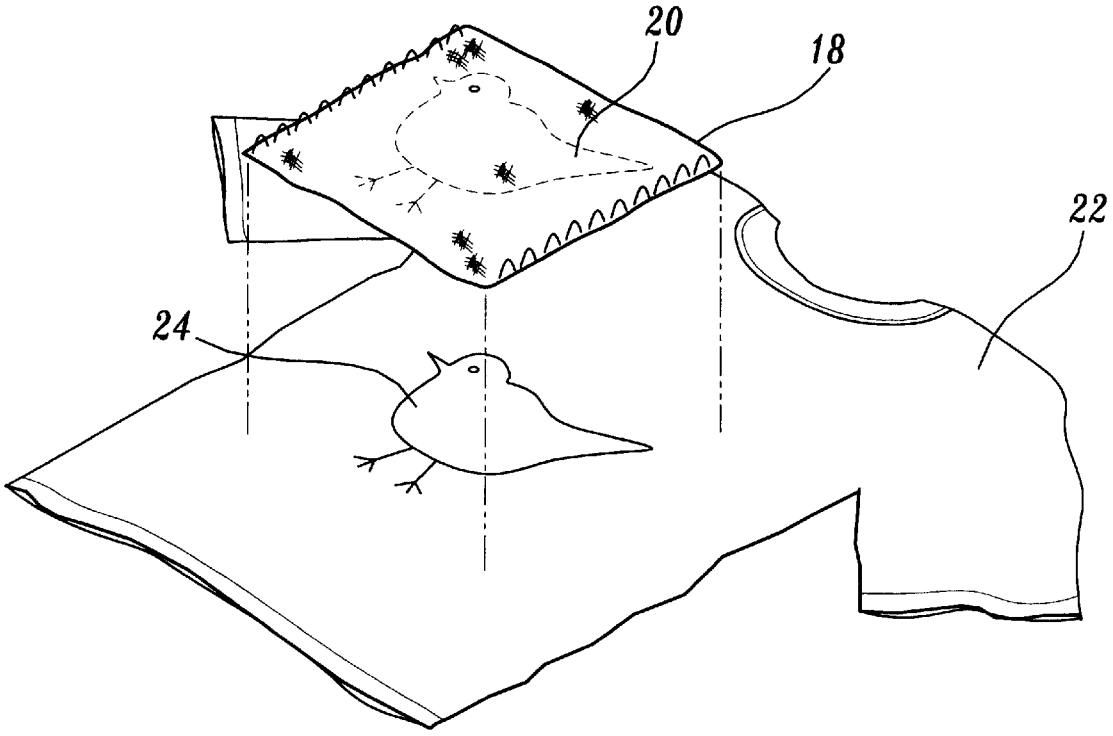
FIG. 2 is an exploded perspective view of an embodiment of an appliqué garment formed in accordance with the present invention.

FIG. 2 is an exploded perspective view of one embodiment of an appliqué garment formed in accordance with the present invention. Illustrated is a mesh-like material layer 18 with a first image 20, an underlying substrate 22 with a second image 24. The first and second images 20, 24 are preferably formed as printings (e.g., inkings, silk screenings, stampings, etc.) on the layer and substrate, respectively. It is preferable that the method of forming the first image 20 does not greatly interfere with the characteristic of the mesh-like material layer 18 to show the second image 24 therethrough.

Figure 3:
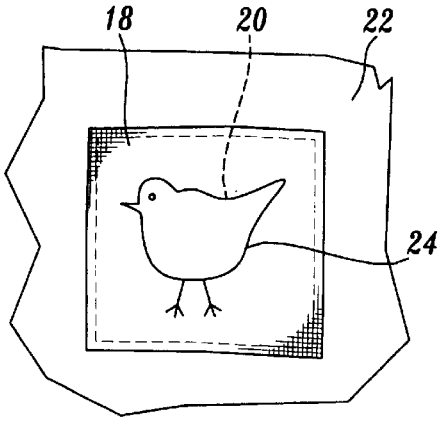
FIG. 3 is a plan view of a portion of an appliqué garment formed in accordance with the present invention.
Figure 4:
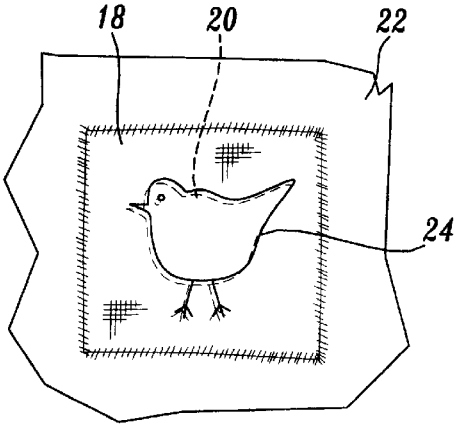
FIG. 4 is a plan view of a portion of another appliqué garment formed in accordance with the present invention.

Referring to FIG. 3, in one embodiment, the attachment of layer 18 to substrate 22 is accomplished such that the first image 20 is directly overlaid upon the second image 24. Referring to FIG. 4, in a second embodiment, the attachment is accomplished such that the first image is overlaid upon the second image in a slightly offset manner. The offset may be accomplished by shifting the first layer laterally relative to the second layer, or by rotating the first layer relative to the second layer, or by some combination of the shifting and rotation. In one embodiment, the first layer is shifted by an amount in the range of about 1 cm to about 5 cm. In another embodiment, the first layer is rotated relative to the second layer by an amount of approximately 3 degrees.

Figure 5:
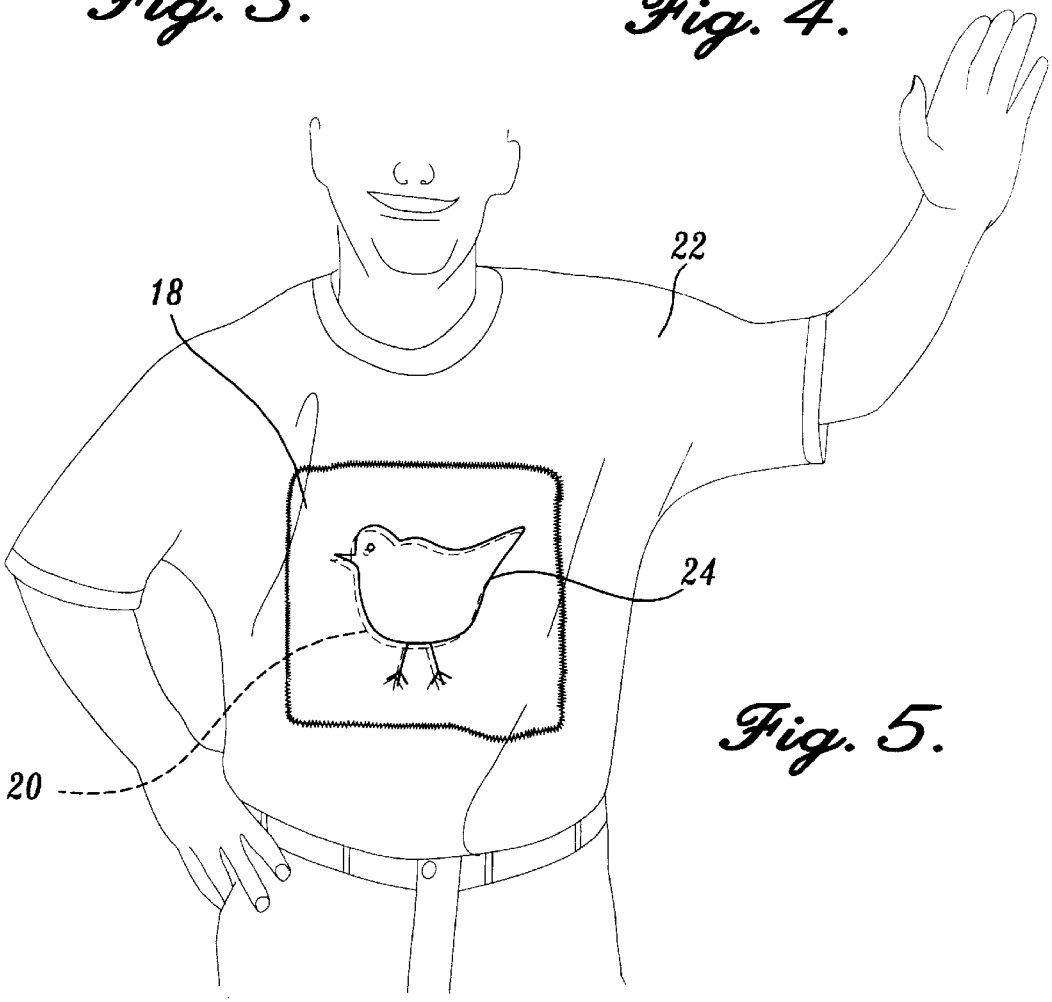
FIG. 5 is a perspective view of yet another appliqué garment formed in accordance with the present invention.

The attachment of the mesh-like material layer 18 to the substrate 22 is done in a manner that allows portions of the layer 18 to move relative to the substrate 22. By attaching the mesh-like material layer over the substrate in this way, the resulting combined image appears three-dimensionalized. See FIG. 5. If the attachment is accomplished with the first image 20 being located directly above the second image 24, then the three-dimensional effect will only appear when the person moves to cause the first image 20 of the mesh-like material layer 18 to become slightly offset from the second image 24. If the attachment is accomplished with the first image 20 being located slightly offset (either rotated and/or shifted) from the second image 24, then the three-dimensional effect will be present without requiring movement of the layers relative to one another.

The mesh-like material layer is a flexible fabric having a plurality of openings through which an underlying image may be viewed. In this regard, there may be any number of openings that are either large or small, or some combination of large and small openings. Example mesh-like materials include polyester, nylon, plastic, organza, gauze, netting, hosiery, sheer fabrics, etc. There are numerous other such mesh-like materials that would be readily identifiable to those skilled in the art upon reading this disclosure and that are considered to be within the scope of this invention. The important feature of the first layer being its ability to allow an underlying image to show through. The underlying substrate may be formed of any desired suitable material.

The attachment of the mesh-like material layer to the substrate is preferably accomplished by sewing the layer directly to the substrate. Other attachment methods may be used, e.g., embroidery, gluing, weaving, pinning, knotting, etc. Again, there are numerous other attachment methods that would be readily identifiable to those skilled in the art upon reading this disclosure and that are considered to be within the scope of this invention. In one embodiment, the substrate is a cotton T-shirt and the mesh-like material layer is a sheer tightly-formed netting of polyester organza attached via embroidery to the substrate at a rotated offset. The stitching is provided along the edge of the first layer so that the interior regions of the mesh layer move readily when the person moves.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of appliqué to form the appearance of a three-dimensionalized image, the method comprising:

(a) forming a first image on a mesh-like material layer;

(b) forming a second image on an underlying substrate, the first and second images being substantially the same images; and (c) attaching the mesh-like material layer to the substrate so that the first image overlays the second image.

2. The method according to claim 1, wherein the mesh-like material layer is a patch of sheer tightly-woven polyester organza netting and the underlying substrate is a cotton T-shirt.

3. The method according to claim 1, wherein the mesh-like material layer is attached to the substrate such that the first image directly overlays the second image.

4. The method according to claim 1, wherein the mesh-like material layer is attached to the substrate such that the first image overlays the second image with a slight offset.

5. The method according to claim 4, wherein the mesh-like material layer is rotated relative to the substrate by an amount of approximately 3 degrees.

6. The method according to claim 1 wherein the first image is larger than the second image by an amount of approximately 3%.

7. The method according to claim 1, wherein the mesh-like material layer is attached to the substrate using at least one of sewing, embroidery, gluing, weaving, knitting, and knotting.

8. A textile article of manufacture comprising:

(a) a mesh-like material layer having a first image formed thereon; and (b) an underlying substrate having a second image formed thereon, the first and second images being substantially the same images; the mesh-like material layer being attached to the underlying substrate so that the first image overlays the second image.

9. The article according to claim 8, wherein the mesh-like material layer is a patch of sheer tightly-woven polyester organza netting and the underlying substrate is a cotton T-shirt.

10. The article according to claim 8, wherein the mesh-like material layer is attached to the substrate such that the first image directly overlays the second image.

11. The article according to claim 8, wherein the mesh-like material layer is attached to the substrate such that the first image overlays the second image with a slight offset.

12. The article according to claim 11, wherein the mesh-like material layer is rotated relative to the substrate by an amount of approximately 3 degrees.

13. The article according to claim 8, wherein the first image is larger than the second image by an amount of approximately 3%.

14. The article according to claim 8, wherein the mesh-like material layer is attached to the substrate using at least one of sewing, embroidery, gluing, weaving, knitting, and knotting.

* * * * *